US005286621A

United States Patent [19]

Verbeeck

[11] Patent Number: 5,286,621

[45] Date of Patent: Feb. 15, 1994

[54] METHOD FOR THE PREPARATION OF TABULAR EMULSION GRAINS RICH IN CHLORIDE

[75] Inventor: Ann L. Verbeeck, Begijnendijk, Belgium

[73] Assignee: Agfa-Gevaert, N.V., Mortsel, Belgium

[21] Appl. No.: 935,300

[22] Filed: Aug. 26, 1992

[30] Foreign Application Priority Data

Sep. 20, 1991 [EP] European Pat. Off. ..... 91202446

[51] Int. Cl.[5] ..... G03C 1/035; G03C 1/015; G03C 10/07

[52] U.S. Cl. ..... 430/567; 430/569; 430/614; 430/615

[58] Field of Search ..... 430/567, 569, 614, 615

[56] References Cited

U.S. PATENT DOCUMENTS

| | | | |
|---|---|---|---|
| 5,176,991 | 1/1993 | Jones et al. | 430/569 |
| 5,176,992 | 1/1993 | Maskasky et al. | 430/569 |
| 5,178,997 | 1/1993 | Maskasky | 430/569 |
| 5,183,732 | 2/1993 | Maskasky | 430/569 |
| 5,185,239 | 2/1993 | Maskasky | 430/569 |
| 5,217,858 | 6/1993 | Maskasky | 430/567 |
| 5,221,602 | 6/1993 | Maskasky | 430/569 |

FOREIGN PATENT DOCUMENTS

| | | | |
|---|---|---|---|
| 0481133 | 4/1992 | European Pat. Off. | 430/567 |

*Primary Examiner*—Charles L. Bowers, Jr.
*Assistant Examiner*—Mark F. Huff
*Attorney, Agent, or Firm*—Breiner & Breiner

[57] ABSTRACT

A method is disclosed for the preparation of silver halide tabular emulsion grains, containing at least 75% chloride, wherein at least 50% of the total projected area of all the grains is provided by said tabular grains, and wherein said tabular grains exhibit an average aspect ratio of at least 5:1, an average thickness not greater than 0.5 micron and an average diameter of at least 0.6 micron, by a process comprising the following steps:

(1) preparing a dispersion medium containing a gelatino-peptizer, and performing the precipitation of the silver halide grains under the following conditions:

(a) the chloride ion concentration in the dispersion medium is lower than 0.15 molar at the start of the precipitation and remains lower than 0.15 molar during the whole precipitation, and pH is maintained between 5.0 and 9.0;

(b) the precipitation is performed in the presence of a crystal habit modifyer according to general formula Ia or Ib:

(Ia)

(Ib)

wherein Z represents the atoms necessary to form a fused on aromatic carbocyclic or heterocyclic, unsubstituted or substituted ring, e.g. substituted with alkyl, alkenyl, aryl, alkoxy, hydroxy, mercapto, carboxy, amino or halogen, and R is hydrogen or a substituent as defined for ring Z; n is 1 or 0, and Q represents carbon in which case n=1, or Q represents nitrogen, in which latter case n=0.

This crystal habit modifier can be added a several different stages of the precipitation. It can be added as a whole in one portion or in several fractions. Preferably this crystal habit modifier is an adenine derivative and most preferably it is adenine itself.

(2) adding to the dispersion medium, during and/or after completion of the precipitation, an amount of a spectral sensitizing dye preferably ranging from $10^{-5}$ mole to $5.10^{-3}$ mole per mole of silver halide (Abstract continued on next page.)

ABSTRACT

-continued at a pH lower than 4.0; in this way adsorbed crystal habit modifier is totally or almost totally desorbed from the tabular emulsion grains;

(3) removing excessive inorganic salts by a procedure starting at a pH lower than 4.0, e.g. ultrafiltration, or flocculation by a polymeric agent or an inorganic salt followed by several washings and redispersion.

10 Claims, 1 Drawing Sheet

METHOD FOR THE PREPARATION OF TABULAR EMULSION GRAINS RICH IN CHLORIDE

FIELD OF THE INVENTION

The present invention relates to the preparation of tabular silver halide emulsion grains rich in chloride with improved developability and to photographic materials containing said grains.

BACKGROUND OF THE INVENTION

Under conventional precipitation conditions silver halide emulsion grains rich in chloride are obtained showing a cubic morphology with (100) crystal faces. Special measures are required to modify this usual crystal habit and this is especially the case in the preparation of tabular grains rich in chloride containing (111) parallel major faces. Several publications reveal the use of so-called "growth modifiers" or "crystal habit modifiers". Klein and Moisar, in Berichte der Bunsengeselschaft 67 (4), p. 349–355, report inhibition of the growth rate of silver chloride by purine bases such as adenine. Claes et al., J. Photogr. Sci. Vol. 21 (1973), p. 39–50, showed that growth modifiers can be used to precipitate octahedral and rhombic dodecahedral silver chloride crystals and they attributed the crystal habit modification to variations in surface hydration caused by those additives; typical examples of these modifiers included adenine, thiourea, hypoxanthine, benzimidazole and benzothiazole derivatives. The mechanism of the growth modifying action of adenine was studied in detail by Szucs in J. Signal AM Vol. 6 (1978) No 5 p. 381–405. In Paper III-13 on the International Congress of Photographic Science Wyrsch reported a triple jet precipitation in the presence of ammonia and Cadmium ions. Depending on pAg and pH control, octahedral (111), rhombododecahedral (110) and cubic (100) crystal habits could be obtained.

In more recent patent applications tabular chloride rich emulsion grains are contemplated. So Wey U.S. Pat. No. 4,399,215 discloses tabular silver chloride emulsion grains with an aspect ratio of at least 8:1 and parallel (111) major crystal faces. Precipitation conditions include the use of ammonia. Rather thick tabular grains are obtained. Wey U.S. Pat. No. 4,414,306 discloses tabular silver chlorobromide grains with at least an annular region where the molar ratio of chloride to bromide ranges up to 2:3.

In U.S. Pat. No. 4,400,463 Maskasky describes the preparation of a new crystallographic form of tabular silver halide grains rich in chloride by performing the precipitation in the presence of a special peptizer having a thioether linkage and an aminoazaindene growth modifier. A preferred growth modifier is adenine. In this example the reaction vessel contained a rather high amount of chloride (0.5 molar) before the start of the precipitation and pH was adjusted to 3.0.

Maskasky U.S. Pat. No. 4,713,323 discloses the preparation of thin tabular grains (less than 0.35 micron) by a precipitation technique wherein at least a 0.5 molar concentration of chloride ion is present in the reaction vessel at the start and oxidized gelatin is used containing less than 30 micromoles of methionine per gram. In a preferred embodiment, illustrated by examples, a growth modifier e.g. an aminoazaindene like adenine is used. In this case the reaction vessel contained 0.5 molar chloride ions and pH was adjusted to 4.0.

Tufano U.S. Pat. No. 4,804,621 describes a process for preparing chloride rich tabular grains in the presence of aminoazapyridine growth modifiers represented by a general formula of which adenine and derivatives are excluded. A preferred compound is e.g. 4-aminopyrazoloE3,4,dlpyrimidine. In this example pCl was maintained at 0.7 and pH at 4.0. Houle and Tufano EP 0 430 196 discloses a method of stabilizing the crystal habit of this type of grains using outer bromide shells. However it can be expected that such a procedure will detoriate some of the specific advantages of chloride rich emulsions, e.g. the fast developability.

Unexamined Japanese Patent Publication (Kokai) 62-218959 describes a method for the preparation of chloride rich emulsion grains with average aspect ratio greater than 5:1 and (111) principal faces for at least 60% of the total grain projection area characterized by the presence of thiourea derivatives. The method is claimed to eliminate the stage of seed crystal preparation. In Unexamined Japanese Patent Publication (Kokai) 01-250943 a photographic material containing similarly prepared grains is claimed; the emulsion layer further contains a sensitizing dye.

In Takada U.S. Pat. No. 4,783,398 tabular grains rich in chloride are disclosed with an aspect ratio ranging from 2:1 to 10:1: they are preferably formed in the presence of a compound represented by a heterocyclic ring containing a sulphur atom.

The preparation of similar grains with an average aspect ratio of at least 5:1 in the presence of a gold compound, preferably combined with a Rhodium or Iridium compound, are described in the Unexamined Japanese Patent Publication (Kokai) 63-213836.

Unexamined Japanese Patent Publication (Kokai) 63-218938 combines tabular grains rich in chloride with the presence of a benzotriazole or mercaptotriazole derivative in the emulsion.

Unexamined Japanese Patent Publication (Kokai) 01-159646 claims the combination of tabular grains rich in chloride prepared in the presence of a crystal habit controlling agent, and a phenol type cyan colour coupler. The material is colour processed using a bleach-fixing bath.

Nishikawa U.S. Pat. No. 4,952,491 discloses a photographic material comprising a silver halide emulsion layer containing tabular grains rich in chloride showing an aspect ratio of at least 2:1, said tabular grains having been precipitated in the presence of a crystal habit controlling amount of a spectral sensitizing dye before and during nucleation and during precipitation.

In The Journal of Photographic Science, Vol. 36, p. 182, Endo and Okaji try to formulate an empirical rule for the modification of the crystal habit of silver chloride to form tabular grains. They conclude a.o. that especially 1,3-dimethyl urea and 1,3-diethyl urea are effective agents in order to obtain high aspect ratio tabular crystals with (111) faces.

In European Patent Application No. 90202792.9. filed 19.10.90, a method is disclosed for the preparation of silver halide tabular emulsion grains, containing at least 75% chloride, wherein at least 50% of the total projected area of all the grains is provided by said tabular grains, and wherein said tabular grains exhibit an average aspect ratio of at least 5:1, an average thickness not greater than 0.5 micron and an average diameter of at least 0.6 micron, by a process comprising the following steps:

preparing a dispersion medium containing a gelatino-peptizer, and a heterocyclic compound according to general formula (Ia) or (Ib), or one of their tautomeric forms, in a concentration ranging from $10^{-4}$ to $10^{-2}$ molar, said medium being adjusted to a pH between 5.0 and 9.0 and to a pCl between 1.0 and 2.0 by means of a chloride ions providing salt; formula (Ia) and (Ib) are:

(Ia)

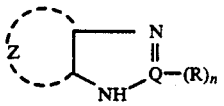

(Ib)

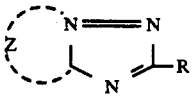

wherein Z represents the atoms necessary to form a fused on aromatic carbocyclic or heterocyclic, unsubstituted or substituted ring, e.g. substituted with alkyl, alkenyl, aryl, alkoxy, hydroxy, mercapto, carboxy, amino or halogen, and R is hydrogen or a substituent as defined for ring Z; n is 1 or 0, and Q represents carbon in which case n=1, or 0 represents nitrogen, in which latter case n=0.

performing a silver halide precipitation comprising at least one double jet step by introducing in said dispersion medium at least one solution containing chloride ions and at least one solution containing silver ions in such a way that pCl is maintained between 1.0 and 2.0. pH is maintained between 5.0 an 9.0 and the concentration of compound (Ia) or (Ib) is maintained between $10^{-4}$ molar and $10^{-2}$ molar;

removing excess of soluble salts by a wash technique performed at a pH value comprised between 4.0 and 9.0; this wash technique is preferably ultrafiltration.

In a preferred embodiment the heterocyclic compound according to general formula (Ia) or (Ib) is an adenine derivative, and in a still more preferred embodiment the heterocyclic compound is adenine itself.

However in the practical application of the method described in this European application serious problems arise concerning the developability of photographic materials containing tabular grains thus prepared. It was stated experimentally that a major part of the crystal habit modifier remains adsorbed at the surface of the tabular grains and that this phenomenon is the cause of the poor developability of those grains. As a result exposed and developed photographic materials containing such grains show inferior sensitometric properties such as an insufficient sensitivity, gradation and maximal density.

The present invention provides a remedy to the deficiencies of the application of the teachings of the European patent application explained above.

It is an object of the present invention to provide an improved method for the preparation of tabular grains rich in chloride.

It is a further object of the present invention to provide photographic materials containing tabular grains rich in chloride, which are readily developable and show excellent sensitometric characteristics.

SUMMARY OF THE INVENTION

The objects of the present invention are realized by providing a method for the preparation of silver halide tabular emulsion grains, containing at least 75% chloride, wherein at least 50% of the total projected area of all the grains is provided by said tabular grains, and wherein said tabular grains exhibit an average aspect ratio of at least 5:1. an average thickness not greater than 0.5 micron and an average diameter of at least 0.6 micron, by a process comprising the following steps :

(1) preparing a dispersion medium containing a gelatino-peptizer, and performing the precipitation of the silver halide grains under the following conditions:

(a) the chloride ion concentration in the dispersion medium is lower than 0.15 molar at the start of the precipitation and remains lower than 0.15 molar during the whole precipitation, and pH is maintained between 5.0 and 9.0;

(b) the precipitation is performed in the presence of a crystal habit modifyer according to general formula Ia or Ib:

(Ia)

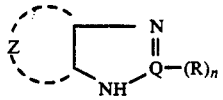

(Ib)

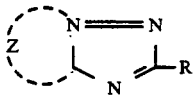

wherein Z represents the atoms necessary to form a fused on aromatic carbocyclic or heterocyclic, unsubstituted or substituted ring, e.g. substituted with alkyl, alkenyl, aryl, alkoxy, hydroxy, mercapto, carboxy, amino or halogen, and R is hydrogen or a substituent as defined for ring Z; n is 1 or 0, and Q represents carbon in which case n=1, or Q represents nitrogen, in which latter case n=0.

This crystal habit modifier can be added at several different stages of the precipitation. It can be added as a whole in one portion or in several fractions. Preferably this crystal habit modifier is an adenine derivative and most preferably it is adenine itself.

(2) adding to the dispersion medium, during and/or after completion of the precipitation, an amount of a spectral sensitizing dye preferably ranging from $10^{-5}$ mole to $5.10^{-3}$ mole, and most preferably ranging from $3.10^{-5}$ mole to $2.10^{-3}$ mole per mole of silver halide at a pH lower than 4.0; in this way adsorbed crystal habit modifier is totally or almost totally desorbed from the tabular emulsion grains with maintenance of the tabular habit;

(3) removing excessive inorganic salts by a procedure starting at a pH lower than 4.0. e.g. ultrafiltration, or flocculation by a polymeric agent or an inorganic salt followed by several washings and redispersion.

DETAILED DESCRIPTION OF THE INVENTION

Figure 1:
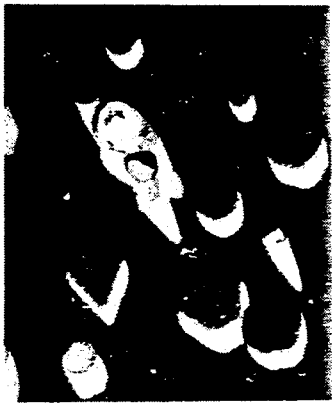
FIG. 1 is a micrograph showing the tabular grain habit of emulsion I.

For the successful execution of the present invention it is essential that the chloride ion concentration in the dispersion medium at the start of the precipitation is lower than 0.15 molar and remains below this value during the whole duration of the precipitation. However the actual start concentration of chloride in the dispersion medium is not very critical and may vary in a rather broad range, preferably between 0.15 molar and 0.015 molar.

During the precipitation the pH should be maintained between 5.0 and 9.0 in order to assure a good adsorption of the crystal habit modifier onto the silver halide grain surface.

Although the precipitation can be principally performed by one double jet step it is preferred to perform a sequence of a nucleation step and at least one growth step. Of the total silver precipitated preferably 0.5% to 5.0% is added curing said nucleation step which consists preferably of an approximately equimolecular addition of silver and halide salts. The rest of the silver and halide salts is added during one or more consecutive double jet growth steps. The different steps of the precipitation can be alternated by physical ripening steps. During the growth step(s) an increasing flow rate of silver and halide solutions is preferably established, e.g. a linearly increasing flow rate. Typically the flow rate at the end is about 3 to 5 times greater then at the start of the growth step. These flow rates can be monitored by e.g. magnetic valves. In the execution of the present invention there is no need for the use of a special oxidized gelatin or the presence of a synthetic peptizer. Conventional lime-treated or acid treated gelatin can be used. Before and during the formation of the silver halide grains it is common practice to establish a gelatin concentration of from about 0.05% to 5.0% by weight in the dispersion medium. Additional gelatin is added in a later stage of the emulsion preparation, e.g. after washing, to establish optimal coating conditions and/or to establish the required thickness of the coated emulsion layer. Preferably a gelatin / silver halide ratio ranging from 0.3 to 1.0 is then obtained.

As stated above in the summary, in a preferred embodiment of the present invention the heterocyclic crystal habit modifying compound according to formula (Ia) or (Ib) is an adenine derivative according to general formula (II):

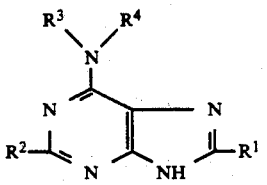

(II)

wherein each of $R^1$ and $R^2$ represents hydrogen, alkyl, alkenyl, aryl, alkoxy, hydroxy, mercapto, carboxy, amino or halogen, and each of $R^3$ and $R^4$ represents hydrogen or alkyl.

In a still more preferred embodiment said adenine derivative is adenine itself (compound Ia-1):

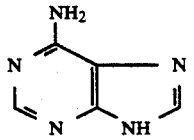

(I-1a)

Specific useful compounds, others than adenine, for use in the present invention include following substances:

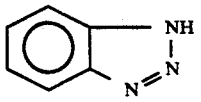

(Ia-2)

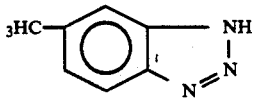

(Ia-3)

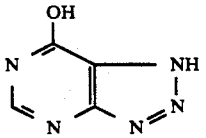

(Ia-4)

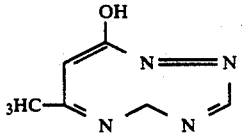

(Ib-1)

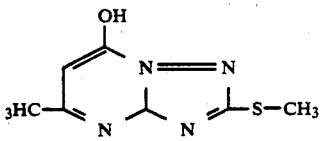

(Ib-2)

During and/or after completion of the precipitation a spectral sensitizing dye preferably in an amount ranging from $4.10^{-5}$ mole to $2.10^{-3}$ mole per mole of silver halide is added to the dispersion medium. In order to obtain a sufficient desorption of the crystal habit modifier it is essential to adjust the reaction mixture to a pH lower than 4.0, preferably 3.0 or even lower. The amount of spectral sensitizer can be added as a whole, e.g. after completion of the precipitation, or can be added in several fractions, e.g. one fraction after the nucleation phase, one or more fractions during the growth step(s) and a final fraction after completion of the precipitation. Examples of preferred spectral sensitizers, which may sensitize for any region of the radiation spectrum, used in accordance with the present invention include:

S-1
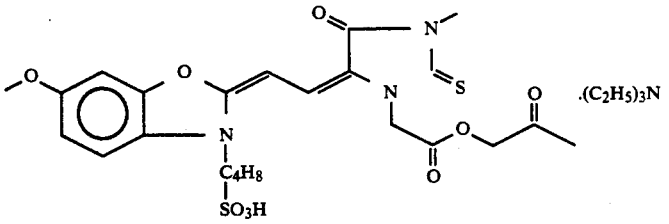
S-2
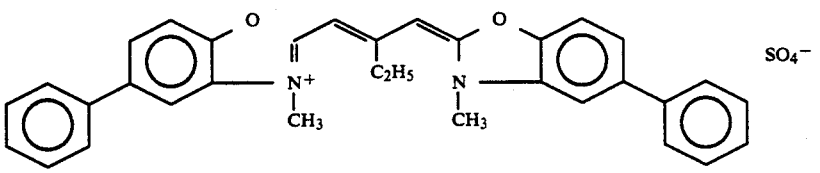
S-3
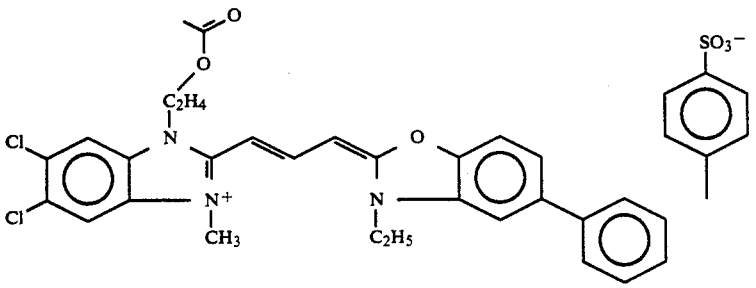
S-4
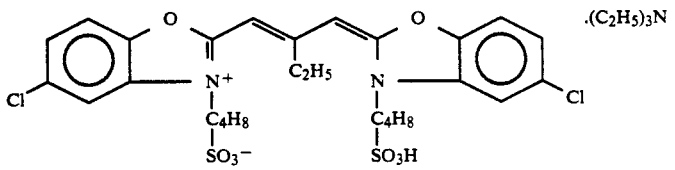
S-5
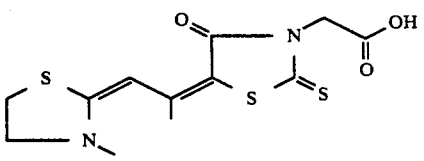
S-6
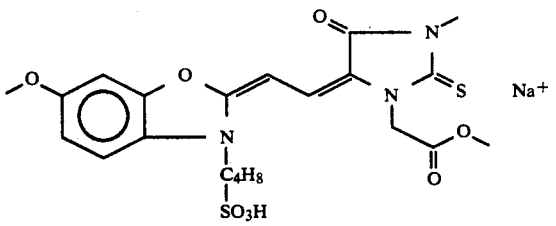
S-7
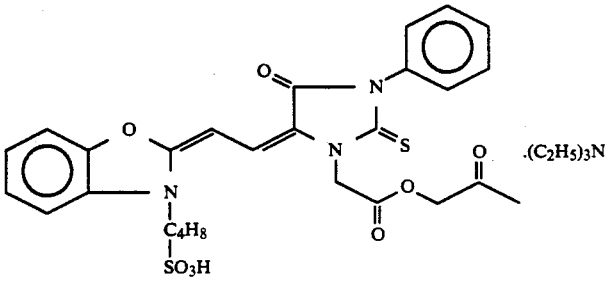

-continued

S-8

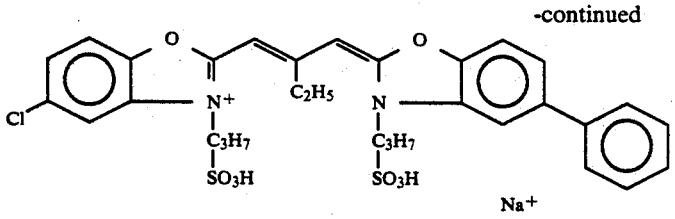

The removal of excessive inorganic salts should be accompanied by a simultaneous removal of the desorbed crystal habit modifier. Therefore the removal procedure has to start at a pH lower than 4.0, preferably 3.0 or lower. Any conventional procedure can be used, e.g. ultrafiltration, or flocculation by a polymeric agent, e.g. polystyrene sulphonic acid of low molecular weight, or flocculation by an inorganic salt, e.g. ammonium sulphate.

It is specifically contemplated that up to 25 molar percent of bromide or both bromide and iodide can be incorporated in the tabular grains of the present invention. This can be achieved by mixing a soluble bromide and/or a soluble iodide salt in one or more of the halide solutions up to 25 mole % of the total halide. On the other hand this incorporation can be performed by adding this soluble bromide and/or iodide salt after formation of substantially pure silver chloride tabular grains. Due to the lower solubility of their corresponding silver salts bromide and iodide ions are able to displace chloride from the grain, a technique known in the art as conversion.

Two or more types of tabular silver halide emulsions that have been prepared differently can be mixed for forming a photographic emulsion for use in accordance with the present invention.

The tabular silver halide emulsions in connection with the present invention can be chemically sensitized as described e.g. in Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners or by means of reductors e.g. tin compounds as described in GB 789,823, amines, hydrazine derivatives, formamidine-sulphinic acids, and silane compounds.

The photographic tabular grains in connection with the present invention can be used in various types of photographic elements. Because of their chloride rich character they are preferably used for those applications which do not require extreme high sensitivity. Preferred embodiments include graphic arts e.g. recording materials for the output of scanners, phototypesetters and imagesetters, duplicating materials, radiographic hard-copy materials, diffusion transfer materials and black-and-white or colour print materials which produce prints starting from negatives in amateur or professional still photography or prints for cinematographic exhibition.

The photographic element can contain one single emulsion layer, as it is the case for many applications, or it can be built up by two or even more emulsion layers. In the case of color photography the material contains blue, green and red sensitive layers each of which can be single or multiple. Beside the light sensitive emulsion layer(s) the photographic material can contain several non-light sensitive layers, e.g. a protective layer, one or more backing layers, one or more subbing layers, and one or more intermediate layers e.g. filter layers.

The silver halide emulsion layer(s) in accordance with the present invention or the non-light-sensitive layers may comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75-39537, and GB 1,500,278, and 7-hydroxy-s-triazolo-[1,5-al-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are metal salts such as e.g. mercury or cadmium salts and the compounds described in Research Disclosure NO 17643 (1978), Chapter VI.

In the preferred embodiment of a photographic material for colour print purposes, the usual ingredients specific for colour materials can be present e.g. colour couplers, couplers bearing a releasable photographic useful group and scavengers for oxidized developer. These typical ingredients for colour materials can be soluble or added in dispersed form, e.g. with the aid of so-called oilformers or they can be added in polymeric latex form.

The gelatin binder of the photographic elements can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydatitoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in European Patent Application No 90.201850.6.

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration. Preferred surface-active coating agents are compounds containing perfluorinated alkyl groups.

Development acceleration can be accomplished with the aid of various compounds, preferably polyalkylene derivatives having a molecular weight of at least 400 such as those described in e.g. U.S. Pat. No. 3,038,805, 4,038,075, 4,292,400.

The photographic element of the present invention may further comprise various other additives such as e.g. compounds improving the dimensional stability of the photographic element, UV-absorbers, spacing agents and plasticizers.

Suitable additives for improving the dimensional stability of the photographic element are e.g. dispersions of a water-soluble or hardly soluble synthetic polymer e.g. polymers of alkyl(meth)acrylates, alkoxy(-meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth-)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455. UV-absorbers are especially useful in colour print materials where they prevent the fading by light of the colour images formed after processing.

Spacing agents can be present of which, in general, the average particle size is comprised between 0.2 and 10 micron. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

As stated above the photographic material can contain several non light sensitive layers, e.g. an anti-stress top layer, one or more backing layers, and one or more intermediate layers eventually containing filter-or anti-halation dyes that absorb scattering light and thus promote the image sharpness. Suitable light-absorbing dyes are described in e.g. U.S. Pat. No. 4,092,168, U.S. Pat. No. 4,311,787, DE 2,453,217, and GB 7,907,440. One or more backing layers can be provided at the non-light sensitive side of the support. These layers which can serve as anti-curl layer can contain e.g. matting agents like silica particles, lubricants, antistatic agents, light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an Alpha-olefin polymer, e.g. a polyethylene layer which optionally contains an anti-halation dye or pigment. It is also possible to use an organic resin support e.g. cellulose nitrate film, cellulose acetate film, polyvinyl acetal film, polystyrene film, polyethylene terephthalate film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material containing tabular grains prepared according to the present invention can be image-wise exposed by any convenient radiation source in accordance with its specific application.

Of course processing conditions and composition of processing solutions are dependent from the specific type of photographic material in which the tabular grains prepared according to the present invention are applied. For example, in the preferred embodiment of materials for graphic arts so-called rapid access developers can be used; alternatively so-called lith developers or the more recent "hard dot rapid access" developers can be used depending on the specific composition and use of the photographic element. Preferably an automatically operating processing apparatus is used provided with a system for automatic regeneration of the processing solutions.

The following examples illustrate the invention without however limiting it thereto.

EXAMPLE I

Preparation of tabular grains according to the invention

Example 1a

The following solutions were prepared:

- 2 l of a dispersion medium (C) containing 0.29 moles of sodium chloride, 10 g of inert gelatin and 180 mg of adenine; temperature was established at 45° C. and pH was adjusted to 5.5;
- a 2.94 molar silver nitrate solution (A);
- a 2.94 molar sodium chloride and a 0.00207 molar adenine solution (B1):

A nucleation step was performed by introducing solution A and solution B1 simultaneously in dispersion medium C both at a flow rate of 20 ml/min during 30 seconds. After a physical ripening time of 15 min during which the temperature was raised to 70° C., 65 g of gelatin, dissolved in 1000 ml of water, was added and the mixture was stirred for an additional 5 minutes. Then a growth step was performed by introducing by a double jet during 3960 seconds solution A starting at a flow rate of 5 ml/min and linearly increasing the flow rate to an end value of 25 ml/min. and solution B1 at an increasing flow rate as to maintain a constant silver potential value, measured by a silver electrode versus calomel, of +92 mV corresponding to a pCl of 1.35.

After completion of the precipitation 292 ml of a 0.3% methanolic solution of spectral sensitizer S-1 was added corresponding to an amount of 0.45 mmole/mole silver halide, expressed as $AgNO_3$. The mixture was stirred for 5 minutes. The pH was adjusted to 3.0 by the addition of diluted sulphuric acid and the mixture was stirred for an additional 15 minutes. The emulsion was flocculated by the addition of 30 ml of a 15% solution of polystyrene sulphonate. The flocculate was washed three successive times by the addition of 41 ml of water followed by decantation. Finally the emulsion was redispersed at pH 5.5 and a pAg corresponding to +92 mV by the addition of water and of 175 g of gelatin to make a final weight of 2.5 kg.

The pure silver chloride emulsion thus obtained (emulsion I) showed following tabular grain characteristics : average diameter=1.25 micron, average thickness=0.13 micron, average aspect ratio=9.7:1 and average sphere equivalent diameter=0.67 micron. The diameter of the grain was defined as the diameter of the circle having an area equal to the projected area of the grain as viewed in a photomicrograph or electron micrograph. The sphere equivalent diameter was defined as the diameter of a hypothetical spherical grain with the same volume as the corresponding tabular grain.

Example 1b

Composition of solutions and precipitation conditions were the same as in example 1a with the exception that the desorption of adenine by the addition of spectral sensitizer was performed in several discontinuous steps. So 32.4 ml of the solution of sensitizer S-1 was added after the nucleation step and then each time after the addition of one quarter, one half and three quarter of the total silver nitrate respectively and the remaining 162 ml was added after completion of the precipitation in order to reach the same total amount of 0.45 mmole/mole $AgNO_3$. Flocculation, washing and redispersion was equal again to example 1.

The thus obtained pure silver chloride emulsion (emulsion II) showed following tabular grain characteristics : average diameter=1.60 micron, average thickness=0.29 micron, average aspect ratio=5.5:1 and average sphere equivalent diameter=1.04 micron.

Example 1c

Composition of solutions and precipitation conditions were the same as in example 1a with the exception that the desorption of adenine by the addition of spectral sensitizer was performed in two distinct stages. So 65 ml of the solution of sensitizer S-1 was added after the nucleation stage and the remaining 227 ml was added after the completion of the precipitation so that the total amount was the same again as in previous examples.

The thus obtained pure silver chloride emulsion (emulsion III) showed following tabular grain characteristics : average diameter=1.81 micron, average thickness=0.31 micron, average aspect ratio=5.7:1 and average sphere equivalent diameter=1.19 micron.

Example 1d

The following solutions were prepared:

- 2 l of a dispersion medium (C) containing 0.29 moles of sodium chloride, 10 g of inert gelatin and 180 mg of adenine; temperature was established at 45° C. and pH was adjusted to 5.8;
- a 2.94 molar silver nitrate solution (A);
- a 2.94 molar sodium chloride and a 0.00207 molar adenine solution (B1);
- a 1.45 molar sodium chloride and a 1.45 molar potassium bromide solution (B2);

A nucleation step was performed by introducing solution A and solution B1 simultaneously in dispersion medium C both at a flow rate of 20 ml/min during 30 seconds. After a physical ripening time of 15 min during which the temperature was raised to 70° C., 65 g of gelatin, dissolved in 1000 ml of water, was added and the mixture was stirred for an additional 5 minutes. Then a first growth step was performed by introducing by a double jet during 3456 seconds solution A starting at a flow rate of 5 ml/min and linearly increasing the flow rate to an end value of 22.45 ml/min, and solution B1 at an increasing flow rate as to maintain a constant silver potential value, measured by a silver electrode versus calomel, of +92 mV. Then a second growth step was performed by introducing by a double jet during 506 seconds solution A starting at a flow rate of 22.45 ml/min and linearly increasing the flow rate to an end value of 25 ml/min, and solution B2 at an increasing flow rate as to maintain a constant silver potential value, measured by a silver electrode versus calomel, of +92 mV.

The desorption of adenine by spectral sensitizer and the final steps of the emulsion preparation were similar to example 1a.

The thus obtained silver halide emulsion (emulsion IV) consisting of 90% of chloride and 10% of bromide showed following tabular grain characteristics : average diameter=1.28 micron, average thickness=0.23 micron, average aspect ratio=5.7:1 and average sphere equivalent diameter =0.82 micron.

Example 1e

The following solutions were prepared:

- 2 l of a dispersion medium (C) containing 0.29 moles of sodium chloride, 10 g of inert gelatin and 180 mg of adenine; temperature was established at 45° C. and pH was adjusted to 5.8;
- a 2.94 molar silver nitrate solution (A);

a 2.94 molar sodium chloride and a 0.00207 molar adenine solution (B1);

a 2.87 molar sodium chloride and a 0.00735 molar potassium iodide solution (B2);

A nucleation step was performed by introducing solution A and solution B1 simultaneously in dispersion medium C both at a flow rate of 20 ml/min during 30 seconds. After a physical ripening time of 15 min during which the temperature was raised to 70° C., 65 g of gelatin, dissolved in 1000 ml of water, was added and the mixture was stirred for an additional 5 minutes. Then a first growth step was performed by introducing by a double jet during 3456 seconds solution A starting at a flow rate of 5 ml/min and linearly increasing the flow rate to an end value of 22.45 ml/min, and solution B1 at an increasing flow rate as to maintain a constant silver potential value, measured by a silver electrode versus calomel, of +92 mV. Then a second growth step was performed by introducing by a double jet during 506 seconds solution A starting at a flow rate of 22.45 ml/min and linearly increasing the flow rate to an end value of 25 ml/min, and solution B2 at an increasing flow rate as to maintain a constant silver potential value, measured by a silver electrode versus calomel, of +92 mV.

The desorption of adenine by spectral sensitizer and the final steps of the emulsion preparation were similar to example 1*a*.

The thus obtained silver halide emulsion (emulsion V) consisting of 99.5% of chloride and 0.5% of iodide showed following tabular grain characteristics : average diameter=1.34 micron, average thickness=0.18 micron, average aspect ratio=7.4:1 and average sphere equivalent diameter =0.79 micron.

Example 1*f*

The following solutions were prepared:

2.5 l of a dispersion medium (C) containing 0.0035 mole of potassium bromide and 12 g of inert gelatin ; temperature was established at 30° C. and pH was adjusted to 5.8:

a 2.94 molar silver nitrate solution (A);

a 2.94 molar potassium bromide solution (B1);

a 2.94 sodium chloride and a 0.00207 molar adenine solution (B2);

A nucleation step was performed by introducing solution A and solution B1 simultaneously in dispersion medium C both at a flow rate of 20 ml/min during 30 seconds. After a physical ripening time of 20 min during which the temperature was raised to 70° C., 75 g of gelatin and 0.18 g of adenine, dissolved in 500 ml of water, were added and the mixture was stirred for an additional 5 minutes. Then a first growth step was performed by introducing by a double jet during 972 seconds solution A starting at a flow rate of 2.5 ml/min and linearly increasing the flow rate to an end value of 7.5 ml/min, and solution B1 at an increasing flow rate as to maintain a constant silver potential value, measured by a silver electrode versus calomel, of −33 mV. After a physical tipening time of 1 min, a second growth step was performed by introducing by a double jet during 3348 seconds solution A starting at a flow rate of 7.5 ml/min and linearly increasing the flow rate to an end value of 25 ml/min, and solution B2 at an increasing flow rate as to maintain a constant silver potential value, measured by a silver electrode versus calomel, of +92 mV.

The desorption of adenine by spectral sensitizer and the final steps of the emulsion preparation were similar to example 1*a*.

The thus obtained silver halide core/shell emulsion (emulsion VI) consisting of 90% of chloride and 10% of bromide, all the bromide being located in the core, showed following tabular grain characteristics : average diameter=0.98 micron, average thickness=0.33 micron, average aspect ratio=3.0:1 and average sphere equivalent diameter=0.98 micron.

Example 1*g*: control emulsions

A control emulsion (emulsion I*) was prepared in an identical way as emulsion I from example la with the exception that no addition of spectral sensitizer was performed and the emulsion was washed by ultrafiltration at pH 5.0 as described in European patent application No 90202792.9 cited above. In this way the tabular habit was maintained but no desorption of adenine could occur.

A second control emulsion (emulsion I**) was prepared in an identical way as emulsion I from example 1a, including the flocculation at pH 3.0 and subsequent washings, with the exception that no addition of spectral sensitizer occurred. In this way however the tabular character of the emulsion grains was lost as will be illustrated in example 4.

EXAMPLE 2

Sensitometric evaluation.

The emulsions of example 1 were chemically ripened by conventional sulphur-gold sensitizers and then coated at a coverage of 7 g/m$^2$, expressed as $AgNO_3$. A protective layer was applied containing formaldehyde-hardened gelatin at a coverage of 1 g/m$^2$. Coated samples were exposed by tungsten light through a continuous tone wedge. They were developed in a conventional hydroquinone-Phenidone black-and-white developer, fixed in a conventional ammonium thiosulphate containing fixer, washed and dried.

The sensitometric evaluation is represented in table 1. The relative sensitivity (rel. S) is expressed as log Et difference at density 0.2 above fog compared to control emulsion I*.

TABLE 1

| emulsion sample | | fog | rel. S | Sensitometry gradation | Dmax |
|---|---|---|---|---|---|
| I* | control | 0.06 | comp. | — | 1.78 |
| I | invention | 0.14 | +0.71 | 1.92 | 2.68 |
| II | invention | 0.13 | +0.83 | 1.87 | 2.49 |
| III | invention | 0.16 | +0.85 | 1.82 | 2.45 |
| IV | invention | 0.29 | +0.70 | 1.23 | 2.47 |
| V | invention | 0.06 | +0.88 | 1.90 | 4.00 |
| VI | invention | 0.28 | +0.61 | 1.76 | 3.01 |

As can be seen from table 1 the obtained sensitivity and gradation of the tabular grains containing emulsions in accordance with the present invention are far superior compared to the sensitivity and gradation obtained with the control emulsion.

EXAMPLE 3

Desorption of adenine by spectral sensitizers.

After desorption by a spectral sensitizer at pH 3.0 the concentration of adenine remaining adsorbed at the silver halide grains was determined analytically. In table IIa the effect of sensitizer S-1 on different emulsions is represented ; table IIb shows the results of experiments in which the precipitation scheme of emulsion I is repeated but the desorption is effected by different spectral sensitizers in table IIc analogous experiments at pH 2.0 are presented:

TABLE IIa

| emulsion | sensitizer | % remaining adenine |
|---|---|---|
| control I* | S-1 | 100 |
| I | " | 38 |
| II | " | 47 |
| III | " | 44 |
| IV | " | 55 |
| V | " | 32 |

TABLE IIb

| emulsion | sensitizer | % remaining adenine |
|---|---|---|
| I | S-4 | 10 |
| " | S-2 | 13 |
| " | S-5 | 13 |
| " | S-8 | 14 |
| " | S-3 | 16 |
| " | S-7 | 19 |
| " | S-6 | 31 |

TABLE IIc

| emulsion | sensitizer | % remaining adenine |
|---|---|---|
| I | S-5 | 5 |
| " | S-3 | 8 |
| " | S-7 | 10 |

Electron Micrographs.

Figure 2:
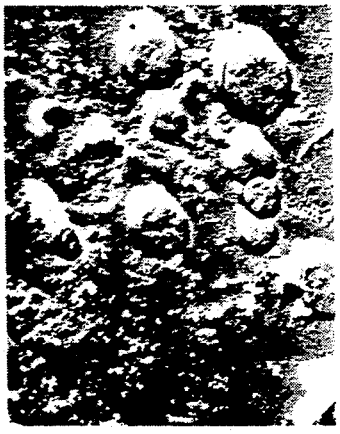
FIG. 2 is a micrograph of control emulsion I*.
Figure 3:
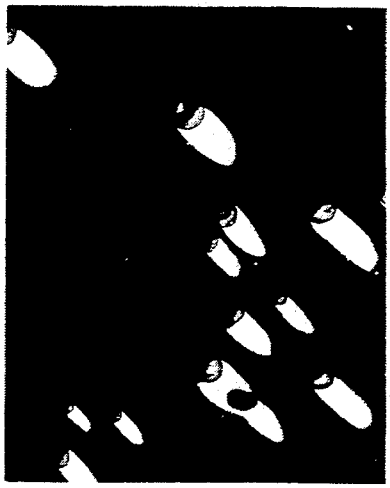
FIG. 3 is a micrograph of control emulsion I**.

Micrograph FIG. 1 shows the tabular grain habit of emulsion I prepared according to the method of the present invention. As can be seen from micrograph FIG. 2 the tabular character in maintained after washing in the case of control emulsion I* while on the contrary it is lost in the case of control emulsion I** (micrograph FIG. 3).

I claim:

1. Method for the preparation of silver halide tabular emulsion grains, containing at least 75% chloride, wherein at least 50% of the total projected area of all the grains is provided by said tabular grains, and wherein said tabular grains exhibit an average aspect ratio of at least 5:1, an average thickness not greater than 0.5 micron and an average diameter of at least 0.6 micron, by a process comprising the following steps:

(1) preparing a dispersion medium containing a gelatino-peptizer, and performing the precipitation of the silver halide grains under the following conditions:

(a) the chloride ion concentration in the dispersion medium is lower than 0.15 molar at the start of the precipitation and remains lower than 0.15 molar during the whole precipitation, and pH is maintained between 5.0 and 9.0;

(b) the precipitation is performed in the presence of a crystal habit modifyer according to general formula Ia or Ib:

(Ia)

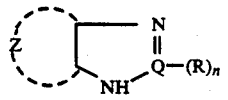

(Ib)

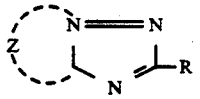

wherein Z represents the atoms necessary to form a fused on aromatic carbocyclic or heterocyclic, unsubstituted or substituted ring, e.g. substituted with alkyl, alkenyl, aryl, alkoxy, hydroxy, mercapto, carboxy, amino or halogen, and R is hydrogen or a substituent as defined for ring Z; n is 1 or 0, and Q represents carbon in which case n=1, or Q represents nitrogen, in which latter case n=0.

A (2) adding to the dispersion medium, during and/or after completion of the precipitation, a spectral sensitizing dye at a pH lower than 4.0.

(3) removing excessive inorganic salts by a procedure starting at a pH lower than 4.0.

2. Method according to claim 1 wherein said crystal habit modifyer according to general formula Ia or Ib is an adenine derivative according to general formula (II):

(II)

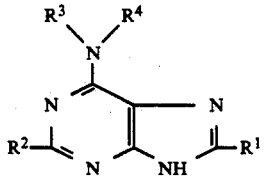

wherein each of $R^1$ and $R^2$ represents hydrogen, alkyl, alkenyl, aryl, alkoxy, hydroxy, mercapto, carboxy, amino or halogen, and each of $R^3$ and $R^4$ represents hydrogen or alkyl.

3. Method according to claim 2 wherein said adenine derivative is adenine itself.

4. Method according to claim 1 wherein said crystal habit modifier is added in a concentration ranging from $5\times10^{-4}$ mole to $10^{-2}$ mole per mole of silver halide.

5. Method according to claim 1 wherein said spectral sensitizer is added in a total amount ranging from $10^{-5}$ mole to $5\times10^{-3}$ mole per mole of silver halide.

6. Method according to claim 1 wherein said spectral sensitizer is added as a whole after completion of the precipitation.

7. Method according to claim 1 wherein said spectral sensitizer is added in several fractions during and after completion of the precipitation.

8. Method according to claim 1 wherein said procedure for the removal of excessive inorganic salts is ultrafiltration.

9. Method according to claim 1 wherein said procedure for the removal of excessive inorganic salts is flocculation by a polymeric agent followed by several washings.

10. Photographic material comprising a support and at least one emulsion layer containing at least one silver halide tabular grain emulsion prepared according to claim 1.

* * * * *